US007325657B2

(12) United States Patent
Angst

(10) Patent No.: US 7,325,657 B2
(45) Date of Patent: Feb. 5, 2008

(54) ELEVATOR INSTALLATION AND MONITORING SYSTEM FOR AN ELEVATOR INSTALLATION

(75) Inventor: Philipp Angst, Zug (CH)

(73) Assignee: Inventio AG, Hergiswil NW (CH)

( * ) Notice: Subject to any disclaimer, the term of this patent is extended or adjusted under 35 U.S.C. 154(b) by 638 days.

(21) Appl. No.: 10/981,171

(22) Filed: Nov. 4, 2004

(65) Prior Publication Data

US 2005/0098390 A1 May 12, 2005

(30) Foreign Application Priority Data

Nov. 11, 2003 (EP) ..... 03405804

(51) Int. Cl.
*B66B 1/18* (2006.01)

(52) U.S. Cl. ..... 187/393; 187/247; 187/314

(58) Field of Classification Search ..... 187/247, 187/248, 277, 288, 391–393, 313, 314; 700/3, 700/20, 21, 27; 340/3.1, 3.5, 3.52, 7.46, 340/7.47; 709/208, 209, 211, 203, 217, 218, 709/219, 238, 245; 710/110
See application file for complete search history.

(56) References Cited

U.S. PATENT DOCUMENTS 4,724,931 A * 2/1988 Ichioka ..... 187/247
5,387,769 A * 2/1995 Kupersmith et al. ..... 187/248
5,654,531 A * 8/1997 Farabee et al. ..... 187/247
6,173,814 B1 * 1/2001 Herkel et al. ..... 187/288
6,267,219 B1 7/2001 Spannhake et al.
6,467,583 B1 * 10/2002 Koura et al. ..... 187/247
7,252,180 B2 * 8/2007 Deplazes et al. ..... 187/393
2004/0173410 A1 * 9/2004 Deplazes et al. ..... 187/247
2005/0029055 A1 * 2/2005 Deplazes et al. ..... 187/391
2006/0157305 A1 * 7/2006 DePlazes et al. ..... 187/391

FOREIGN PATENT DOCUMENTS

EP 1 117 018 7/2001
WO WO 03/020627 3/2003
WO WO 03/024856 3/2003

* cited by examiner

*Primary Examiner*—Jonathan Salata
(74) *Attorney, Agent, or Firm*—Fraser Clemens Martin & Miller LLC; Willam J. Clemens

(57) ABSTRACT

An elevator installation with an elevator car moveable in an elevator hoistway by means a drive unit is controlled by a control unit. Sensors monitor the status of the elevator installation and are each connected via an assigned bus node to a data bus and thereby connected to the control unit. In order to obtain improved operational safety and improved availability, each sensor controls a voltage supply of the associated bus node.

18 Claims, 2 Drawing Sheets

ELEVATOR INSTALLATION AND MONITORING SYSTEM FOR AN ELEVATOR INSTALLATION

BACKGROUND OF THE INVENTION

The present invention relates to an elevator installation with an elevator car, which by means of a drive unit can be caused to move in an elevator hoistway. The elevator installation can be controlled by a control unit. To monitor the status of the elevator installation sensors are also provided, each of which is connected via an assigned bus node to a data bus and thereby to the control unit. In addition, the invention relates to a monitoring system for an elevator installation, which comprises several bus nodes. The bus nodes are connected via a data bus to a control unit, there being assigned to each bus node a sensor. The sensor connected to the bus node is provided for the purpose of monitoring the status of the elevator installation.

In prior art elevator installations, safety contacts are used to detect the status of the elevator installation. Conventional elevator installations use safety contacts which are connected to each other in series, in an operable status of the elevator installation all safety contacts being closed, so that a positive status signal from the elevator installation can be evaluated in a control unit. Disadvantageous with such manner of connecting the safety contacts is that no diagnosis is possible as to whether one or more safety contacts are faulty. Consequently, no suitable measures can be taken by the control unit to control the elevator installation. Moreover, with such manner of connecting the safety contacts, no identification of the safety contacts is possible, and it is also impossible to transmit further information about intermediate statuses or counter values, etc.

Nowadays, safety contacts connected in such manner are frequently replaced by bus systems to which the safety contacts are connected. These bus systems must satisfy the special safety requirements for elevator installations.

In patent document WO 03/020627 A1 an elevator system is described in which detection means are arranged which, in case of a fault in the area of the hoistway doors or car doors, a control provides fault information regarding the type of fault and location of the fault. The control is therefore able to trigger a situation-dependent safe reaction which takes into account the type of fault, the location of the fault, and information about the status. The detection means which comprise, for example, a circuit-opening switch, a circuit-completing switch, a Hall sensor, etc., are connected to a control unit of the elevator installation via a bus system. To adapt this bus system to the safety requirements, use is made of, for example, distributed sensors, there being provided in each case two or more sensors for mutual monitoring or mutual support. It is further foreseen that should a fault occur, the detection means are set into a safe status so as not to affect the elevator system negatively. The detection means are connected to the bus system via bus nodes, the safety of the bus nodes being improved by built-in redundancy which increases the safety of the entire system.

Disadvantageous with such built-in redundancy is that a bus node can also transmit a faulty signal to the control even though the sensor assigned to this bus node detects a fault-free or operable status of the elevator installation and no faulty status is in fact present.

SUMMARY OF THE INVENTION

A purpose of the present invention is to eliminate the aforementioned problems and propose an elevator installation and a monitoring system for an elevator installation with improved operating safety and improved availability.

This purpose is fulfilled according to the present invention by an elevator installation in which a sensor assigned to a bus node controls a voltage supply of the bus node.

The present invention is based on the idea that a bus node which is not supplied with a voltage cannot transmit a faulty status signal to the control unit, so that should a status be interrogated, no status signal results. By this means, the transmission of fault-free statuses even though a fault is present can be prevented. According to the present invention, this is done by the sensor's controlling the voltage supply of the bus node depending on the detected status of the elevator installation.

In an advantageous further development of the present invention, should a status of the sensor occur which characterizes a faulty status of the elevator installation, the voltage supply of the assigned bus node is switched off. This makes transmission of the status of this sensor to the control unit possible only if a fault-free or operable status of the elevator is present. Should a faulty status of the elevator installation be present, the sensor remains in this faulty status and the voltage supply of the assigned bus node remains switched off.

In an advantageous further development of the present invention, the bus node is constructed passively so that the status of the bus node can be interrogated by the control unit. By this means the capital outlay for realization of the bus node remains small.

In an alternative further development of the present invention, the bus node is constructed actively. By this means the bus node transmits the status of the assigned sensor to the control unit. Although bus nodes of this type are constructed more elaborately, with active bus nodes of this type the control unit can be constructed more decentralized and the complexity of the control unit can be reduced.

In an advantageous further development of the present invention it is foreseen that in the absence of a status signal from a bus node within a predetermined period of time, this bus node along with the assigned sensor is categorized by the control unit as faulty. Consequently, a bus node is categorized as faulty if for some time there is no response from a passive bus node, or in the case of an active bus node the bus node transmits no status signal to the control unit. The control unit is therefore able to recognize whether the sensor is in a fault-free or a faulty state.

Advantageously it is envisaged that the control unit initiates suitable measures for controlling the elevator installation depending on the reported or transmitted statuses of the bus nodes. By means of the diagnosis as to the sensor on which a fault is present, an adequate measure can be taken for targeted improvement of the availability or operating safety of the elevator installation.

In a further advantageous development of the present invention, it is envisaged that the bus node, when transmitting the status to the control unit, also transmits an identification. This avoids one bus node from transmitting a status signal for another bus node which is possibly incorrect.

In a further advantageous development of the present invention, the sensor includes a contact which controls the voltage supply of the assigned bus node. The contact can take the form of a circuit-opening switch or a circuit-completing switch. Depending on the requirement, an open or closed contact of the sensor can be interpreted as faulty or as operable.

In a further advantageous development of the present invention, the sensors are constructed contactlessly. By means of, for example, magnetic fields, such sensors register a specific status so that the voltage supply of the assigned bus node can be controlled depending on a specific status of the contactless sensor.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
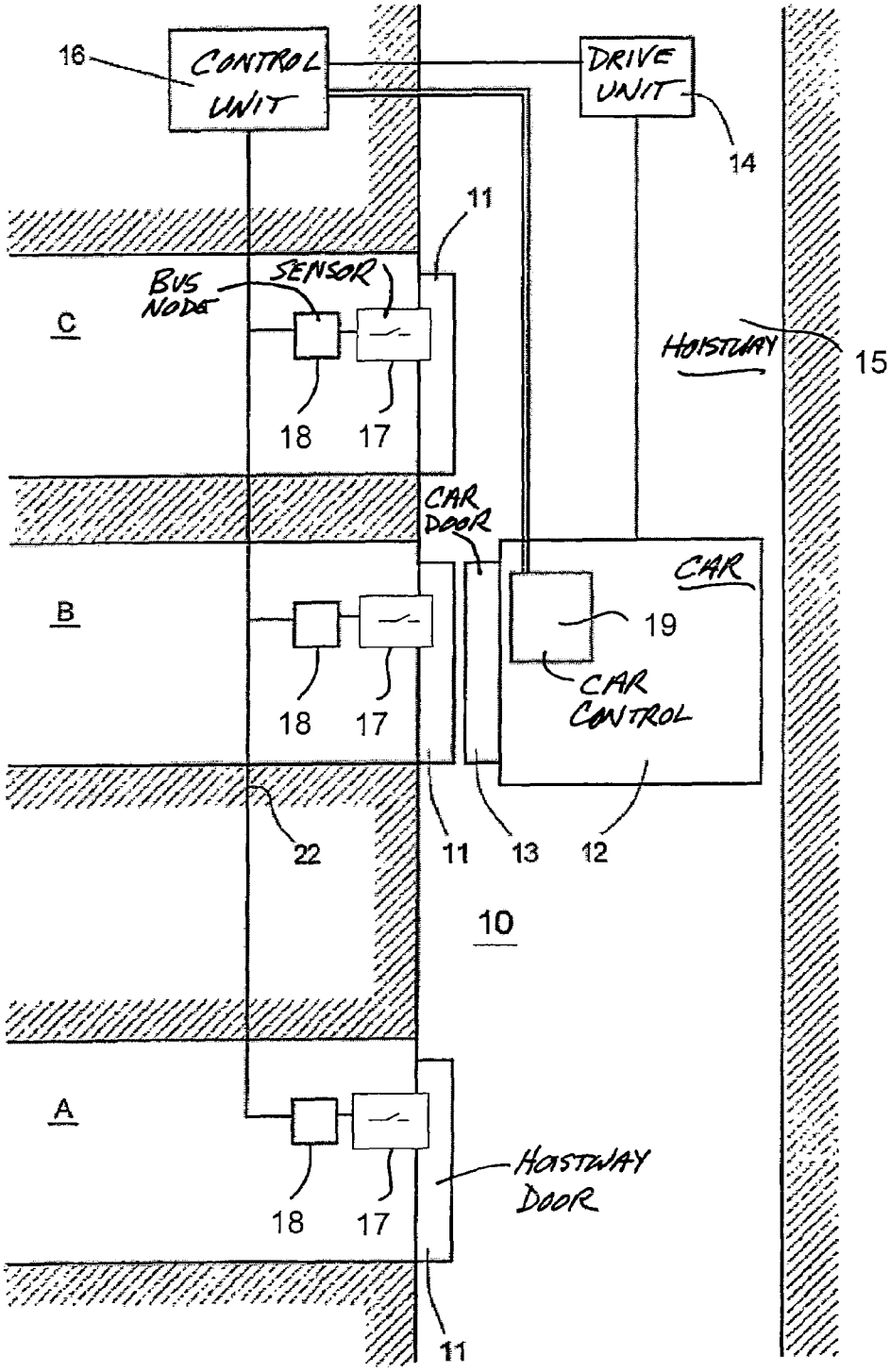
FIG. 1 is a schematic view of an elevator installation according to the present invention.

Represented in FIG. 1 is an elevator installation 10 with an elevator car 12 that is moved in an elevator hoistway 15. The elevator car 12 is moved between floors A, B, and C of a building by a drive unit 14 in the elevator hoistway 15. The elevator car 12 has car doors 13 and a car control 19. Arranged on each of the individual floors A, B, C are hoistway doors 11. Arranged on each hoistway door 11 is at least one sensor 17 which is connected to an assigned bus node 18, the bus node 18 being connected via a data bus 22 to a control unit 16. The respective sensors 17 on the floors A, B, C are constructed as circuit-completing switches which when actuated are closed. The control unit 16 controls the elevator installation 10, and for this purpose is connected to the drive unit 14, to the car control 19, and via the data bus 22 and the bus nodes 18 to the sensors 17 assigned to them. The sensors 17 form a so-called safety circuit. The control unit 16 can also be a door-monitoring unit or simply a monitoring unit.

Figure 2:
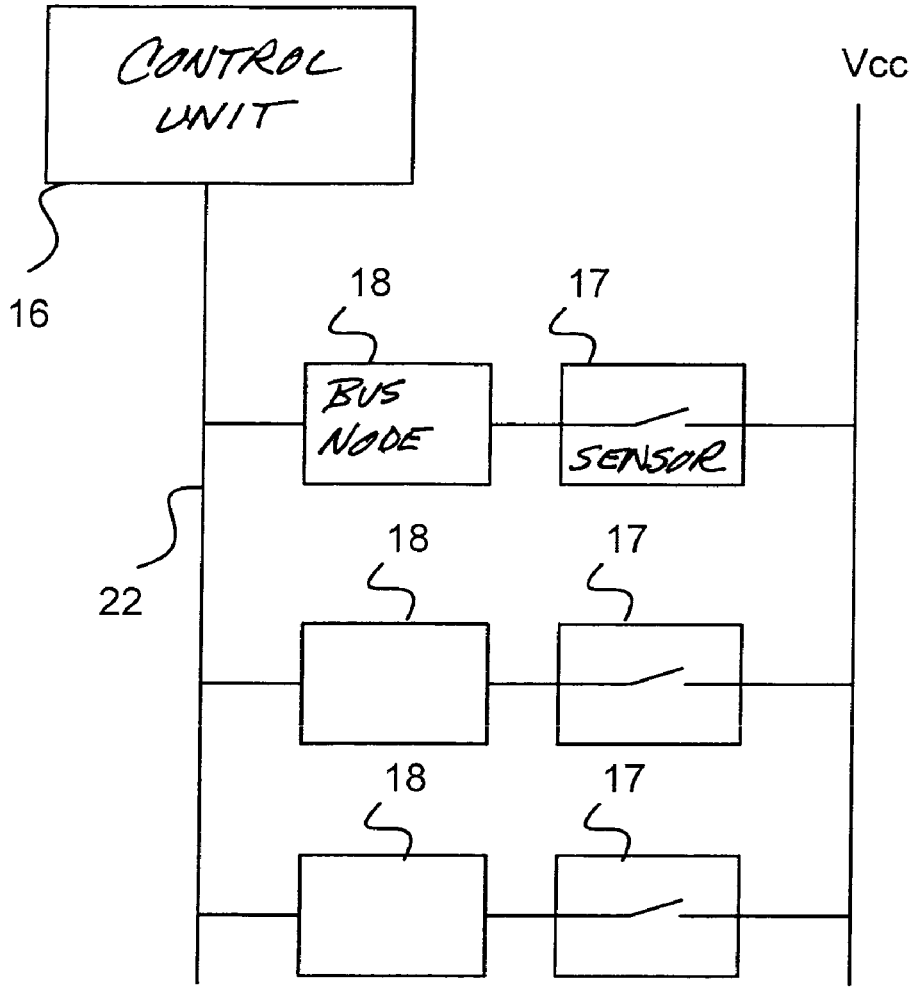
FIG. 2 is a schematic block diagram of the monitoring system shown in FIG. 1.

FIG. 2 shows a monitoring system for controlling the elevator installation 10. The monitoring system comprises the sensors 17, each of which is connected to a voltage-supply conductor Vcc and to the assigned bus nodes 18. The bus nodes 18 are connected to the data bus 22 and thus to the control unit 16. In the exemplary embodiment shown in FIG. 2, the sensors 17 are constructed especially simply in that the sensors 17 each consist only of the circuit-completing switch which is closed when the hoistway doors 11 are closed and which thereby connect the assigned bus nodes 18 to the voltage-supply conductor Vcc. The bus node 18 thus receives the voltage supply required for operation and can either transmit the status of the associated sensor 17 automatically to the control unit 16 or transmit its status to the control unit 16 the next time that it is interrogated. Should a hoistway door 11 not be closed according to regulations, the circuit-opening switch in the associated sensor 17 remains open, and the respective bus node 18 of the sensor 17 on this hoistway door 11 remains without voltage, so that it is unable to transmit its status and/or the status of the assigned sensor 17 to the control unit 16 and is thus recognized by the control unit 16 as faulty.

There follows a description of the method of functioning of the safety circuit formed by the sensors 17. As is well known, elevator installations are subject to high safety standards. In order to fulfill these safety standards, prior to a movement of the elevator car 12 in the elevator hoistway 15, the state, or status, of the safety circuit is interrogated. For this purpose the bus nodes 18 can be designed as active bus nodes 18 and consequently, on occurrence of predefined statuses of the elevator installation 10, send their status to the control unit 16 automatically. Alternatively, the bus nodes 18 can be passively constructed and transmit the status of the bus node 18 and/or of the assigned sensor 17 to the control unit 16 by means of a polling procedure. For this purpose, each of the bus nodes 18 is prompted by the control unit 16 at a specific instant to transmit its status.

The control unit 16 receives the statuses of the sensors 17 to be checked, evaluates them, and initiates suitable control processes. The elevator car 12 can, for example, only be moved when all of the sensors 17 indicate the hoistway doors 11 and the car doors 13 are closed. In the exemplary embodiment shown, in the interest of clarity only the sensors 17 on the hoistway doors 11 on the individual floors A, B, and C are shown. Besides these, the elevator installation 10, and especially the safety circuit, can contain further sensors which are not shown. For example, arranged on the top and bottom floors A and C can be end-switches which prevent further travel beyond the respective floor. Also attached to the car door 13 of the elevator car 12 can be one or more sensors that indicate the status of the car door 13.

The voltage supply of the bus nodes 18 is controlled depending on the statuses of the assigned sensors 17. Thus it is ensured that the respective bus node 18 only transmits its status or that of the assigned sensor 17 to the control unit 16 if the sensor 17 indicates a fault-free status. If the sensor 17 has a faulty status, the associated bus node 18 remains without voltage and cannot transmit this status. However, the control unit 16 nevertheless recognizes that a fault is present at this sensor 17 on a certain floor because the status signal from this sensor 17 is absent. Transmission by the bus node 18 of a faulty status to the control unit 16 despite a functioning status of the sensor 17 can thus be avoided.

The control unit 16 recognizes the corresponding fault in the safety circuit and can initiate suitable measures. The simplest measure is an emergency stop of the elevator car 12. However, a forced travel of the elevator car 12 to the ground floor at reduced speed can be initiated, or a service center can be informed. It is also possible for a fault of the sensor 17 of the safety circuit to be registered in a fault log which is stored in a memory of the control unit 16, so that the fault which occurred can be corrected or investigated at the next scheduled maintenance of the elevator installation 10. Especially advantageous with this construction of the safety circuit is the possibility of unique identification of the faulty sensor 17 or bus node 18. On transmission of the status of the sensor 17 or the bus node 18, the bus node 18 also transmits a unique identification so that the control unit 16 can recognize the location of the fault and take suitable measures. In case of a fault on the car doors 13, the control unit 16 can attempt, for example, to close the car doors 13 again by commanding the car control 19 to repeat opening and closing of the doors.

Also included in the safety circuit can be position sensors by means of which it is determined whether the elevator car 12 reaches a permissible position in the elevator hoistway 15 and the doors 11, 13 can be opened. If transmission of a status signal from such a position sensor is absent, this can be because the elevator car 12 has not yet reached the prescribed disembarking position. The control unit 16 recognizes this status and attempts to move the elevator car 12 to a corresponding permissible disembarking position at which the position sensors switch the assigned bus nodes 18 on, so that the status signal regarding the fault-free status of the position sensor can be transmitted to the control unit 16.

Figure 3:
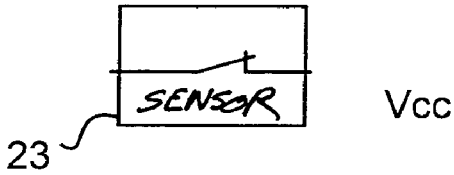
FIG. 3 is a schematic block diagram of a sensor constructed as a circuit-opening switch for use in the monitoring system shown in FIG. 2.

The monitoring system can also include sensors 23 which are constructed as, for example, circuit-opening switches or Hall sensors. FIG. 3 shows the sensor 23 constructed as a circuit-opening switch which on actuation is opened. In this case, with closed hoistway doors 11 the connection to the voltage-supply conductor Vcc is closed so that the assigned bus node 18 is supplied with voltage and its status can be transmitted to the control unit 16. If the hoistway doors 11 are opened, the voltage supply is interrupted and the bus node 18 cannot transmit a faulty status signal.

The sensors 17, 23 can also be constructed contactlessly. For example, proximity switches can be used which react to an electronic or magnetic field. In this case the connection to the voltage supply Vcc is interrupted if, for example, no magnetic field is detected. If the hoistway doors 11 are closed, a magnetic field is recognized by the opposite hoistway door 11 and the voltage-supply conductor in the sensor 17 is connected to the bus node 18.

The sensor 17 can also be designed as a Hall sensor. In this case the voltage supply Vcc of the bus node 18 is controlled electronically in the sensor 17 in such a manner that the bus node 18 remains without voltage if the sensor 17 detects an unsafe or faulty status.

It is also possible to connect several of the sensors 17 to a one of the bus nodes 18 if, for example, redundancy in the safety circuit is required. In this case also, electronic evaluation of the two statuses must take place so that the bus node 18 is only connected to the voltage supply Vcc if the redundantly designed sensor 17 takes on a safe status on both sensors or the voltage supply Vcc is already interrupted if only one of the two sensors possesses an unsafe status.

Also realizable as a transmission method on the data bus 22 is a token ring. In the token-ring method a (virtual) token is passed from one bus node 18 to the next. The individual bus nodes 18 transmit their status signal when they receive the token and then pass the token to the next bus node 18. When the token arrives back at the control unit 16, the control unit 16 recognizes that all of the bus nodes 18 have transmitted their status signals. A similar procedure envisages that the control unit 16 monitors whether it receives a status signal from all of the bus nodes 18 within a predefined period of time of, for example, 5 ms.

As medium for the data bus 22 conventional copper wires can be used, or wireless radio connections, or optical fibers, or other media suitable for communication.

The construction of the elevator installation 10 assures a safety circuit which is so designed that no incorrect transmission of the status present on the sensor 17 by the bus node 18 can occur. Furthermore, use of the bus nodes 18 makes identification of the location of the fault possible. Erroneous failure of a one of the bus nodes 18 to recognize or transmit a dangerous or faulty status can be prevented. By means of identification of the bus node 18 it is guaranteed that no other bus node 18 can transmit a status signal to the control unit 16 under a false address without being detected. It can be ruled out that, for example, the bus node 18 on the floor B communicates in the name of the bus node 18 on the floor A that the bus node 18 on the floor A is fault-free, since in view of an open contact, the bus node 18 on the floor A no longer has a voltage and can no longer respond.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation including an elevator car, a drive unit moving the elevator car in an elevator hoistway, a control unit controlling the elevator installation, and a monitoring system for monitoring the status of the elevator installation, comprising:

a plurality of sensors for sensing the status of the elevator installation;

a voltage supply connected to each of said sensors;

a data bus connected to the control unit; and a plurality of bus nodes connected to said data bus and operated from said voltage supply, each of said bus nodes being connected to an associated one of said sensors whereby each said sensor controls application of said voltage supply to the associated one of said bus nodes.

2. The elevator installation according to claim 1 wherein when said sensors have a status representing a faulty status of the elevator installation, said sensors switch off the voltage supply to the associated one of said bus nodes.

3. The elevator installation according to claim 1 wherein at least one of said bus nodes is constructed passively whereby a status of said associated sensor can be interrogated by the control unit over said data bus.

4. The elevator installation according to claim 1 wherein at least one of said bus nodes is constructed actively for transmitting to said control unit on said data bus a status of said associated sensor.

5. The elevator installation according to claim 1 wherein an absence of a signal generated on said data bus by one of said bus nodes within a predefined period of time represents a faulty condition of said one bus node.

6. The elevator installation according to claim 1 wherein the presence and absence of signals generated by said bus nodes on said data bus causes the control unit to initiate suitable measures for controlling the elevator installation.

7. The elevator installation according to claim 1 wherein each said bus node identifies itself to the control unit.

8. The elevator installation according to claim 1 wherein at least one of said sensors includes a contact which controls connection of the voltage supply to said associated bus node.

9. The elevator installation according to claim 8 wherein a faulty status of the elevator installation is present when said contact is one of closed and open.

10. The elevator installation according to claim 1 wherein at least one of said sensors is constructed contactlessly and connection of said voltage supply to said associated bus node is controlled by a status of said at least one contactless sensor.

11. A monitoring system for an elevator installation comprising:

a data bus connected to a control unit of the elevator installation;

a plurality of bus nodes connected to said data bus;

a voltage supply; and a plurality of sensors for monitoring a status of the elevator installation, each of said sensors being connected to an associated one of said bus nodes, each of said sensors controlling application of said voltage supply to said associated bus node.

12. The monitoring system according to claim 11 wherein said bus nodes are constructed passively and at least one of a status of each of said bus nodes and a status of said associated sensor can be interrogated by said control unit over said data bus.

13. The monitoring system according to claim 11 wherein said bus nodes are constructed actively and at least one of a status of each of said bus nodes and a status of said associated sensor is transmitted to said control unit over said data bus by said bus nodes.

14. The monitoring system according to claim 11 wherein an absence of a status signal generated by one of said bus nodes to the control unit within a predefined period of time represents that said one bus node is faulty.

15. The monitoring system according to claim 11 wherein said bus nodes identify themselves to the control unit when transmitting a status to the control unit.

16. The monitoring system according to claim 11 wherein at least one of said sensors includes a contact which controls application of said voltage supply to said associated bus node, and a faulty status of the elevator installation is represented when said contact is one of closed and open.

17. The monitoring system according to claim 11 wherein at least one of said sensors is constructed contactlessly and application of said voltage supply to said associated bus node is controlled by a status of said at least one contactless sensor.

18. The monitoring system according to claim 11 wherein when one of said sensors has a faulty status, said voltage supply is switched off to said associated bus node.

* * * * *